US006764389B1

(12) United States Patent
Butterfield et al.

(10) Patent No.: US 6,764,389 B1
(45) Date of Patent: Jul. 20, 2004

(54) CONDITIONING BAR ASSEMBLY HAVING AN ABRASION MEMBER SUPPORTED ON A POLYCARBONATE MEMBER

(75) Inventors: James V. Butterfield, Gaston, OR (US); Rakael L. Pope, Gresham, OR (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 10/224,025

(22) Filed: Aug. 20, 2002

(51) Int. Cl.[7] ..... B24B 1/00

(52) U.S. Cl. ..... 451/56; 451/285; 451/289; 451/443

(58) Field of Search ..... 451/285, 289, 451/56, 443; 528/196; 521/85; 524/358

(56) References Cited

U.S. PATENT DOCUMENTS

| | | | | | |
|---|---|---|---|---|---|
| 4,111,977 | A | * | 9/1978 | Mark | 524/358 |
| 5,132,331 | A | * | 7/1992 | Kohler et al. | 521/85 |
| 5,688,360 | A | * | 11/1997 | Jairath | 156/345.12 |
| 5,775,983 | A | * | 7/1998 | Shendon et al. | 451/444 |
| 5,782,675 | A | * | 7/1998 | Southwick | 451/56 |
| 5,885,147 | A | * | 3/1999 | Kreager et al. | 451/443 |
| 5,938,507 | A | * | 8/1999 | Ko et al. | 451/56 |
| 6,004,193 | A | | 12/1999 | Nagahara et al. | |
| 6,139,404 | A | * | 10/2000 | Yau | 451/56 |
| 6,152,813 | A | * | 11/2000 | Suzuki | 451/443 |
| 6,220,936 | B1 | * | 4/2001 | Quek | 451/41 |
| 6,227,948 | B1 | * | 5/2001 | Khoury et al. | 451/56 |
| 6,234,883 | B1 | | 5/2001 | Berman et al. | |
| 6,309,433 | B1 | | 10/2001 | Kinoshita | |
| 6,325,709 | B1 | | 12/2001 | Nanda et al. | |
| 6,354,908 | B2 | | 3/2002 | Allman et al. | |
| 6,462,167 | B1 | * | 10/2002 | Nodera et al. | 528/196 |
| 6,514,126 | B1 | * | 2/2003 | Vanell | 451/72 |
| 6,551,176 | B1 | * | 4/2003 | Garretson | 451/56 |

OTHER PUBLICATIONS

Materials Handbook by Brady, Clausset, and Vaccari—1997.*

* cited by examiner

*Primary Examiner*—George Nguyen
(74) *Attorney, Agent, or Firm*—Maginot, Moore & Beck LLP

(57) ABSTRACT

A conditioning bar assembly includes a polycarbonate member, an abrasion member, and a rigid metal element. The abrasion member is supported on an outer surface of the polycarbonate member. The rigid metal element is supported on the polycarbonate member, at least a portion of the polycarbonate member disposed between the rigid metal element and at least a portion of the abrasion member.

19 Claims, 8 Drawing Sheets

CONDITIONING BAR ASSEMBLY HAVING AN ABRASION MEMBER SUPPORTED ON A POLYCARBONATE MEMBER

FIELD OF THE INVENTION

The present invention relates generally to chemical mechanical planarization of semiconductors, and more particularly, to methods and apparatus for conditioning polishing pads used in chemical mechanical planarization.

BACKGROUND OF THE INVENTION

The concept of applying chemical and mechanical abrasion to a semiconductor substrate is generally known as chemical mechanical planarization or chemical mechanical polishing ("CMP"). Typically, CMP involves mounting a semiconductor wafer on a fixture and rotating the wafer face against a polishing pad. The polishing pad is typically mounted on a moving platen, thereby effecting multiple directions of movement between the rotating wafer and the polishing pad. A slurry containing an abrasive and a chemical that chemically interacts with the wafer face is flowed between the wafer and the polishing pad. In integrated circuit wafer fabrication, CMP is commonly applied to planarize dielectric layers, metallization layers, and other wafer layers.

FIG. 1 shows some major components of a typical CMP apparatus. Examples of such apparatuses are known in the art and are available, for example, from SpeedfamIPEC of Chandler, Ariz. The CMP apparatus 100 includes a wafer carrier 128 that is fitted with an air chamber 126 (shown in phantom lines), which is designed to secure a wafer 124 by vacuum to the wafer carrier 128 during wafer loading typically before the CMP is to commence. During CMP, however, the wafer 124 is bound by "wear rings", not shown, within the wafer carrier 128 such that a wafer surface that is to be polished contacts a polishing pad 102. During CMP, the polishing pad 102 orbits while the wafer 124 rotates.

A conventional polishing pad 102 for use with an apparatus such as illustrated in FIG. 1 includes a plurality of slurry injection holes 120, and adheres to a flexible pad backing 104 which includes a plurality of corresponding pad backing holes 118. A slurry mesh 106, typically in the form of a screen-like structure, is positioned below the pad backing 104. An air bladder 108 capable of inflating or deflating is disposed between a plumbing reservoir 110 and the slurry mesh 106. The air bladder 108 pressurizes to apply the polishing force. A co-axial shaft 112, through which a slurry inlet 114 (shown by phantom lines) is provided to deliver slurry through the plumbing reservoir 110 and the air bladder 108 to the slurry mesh 106, is attached to the bottom of plumbing reservoir 110. Slurry is delivered to the system by an external low pressure pump, and is distributed on the polishing pad surface by centripetal force, the polishing action, and slurry pressure distribution on the pad 102. The polishing pad 102 may also be provided with grooves or perforations (not shown) for slurry distribution and improved pad-wafer contact.

After polishing multiple wafers using the same polishing pad over a period of time, the polishing pad suffers from "pad glazing". As is well known in the art, pad glazing results when particles that have eroded from the wafer surface, along with the abrasives from the slurry, tend to glaze or accumulate over the polishing pad. A glazed layer on the polishing pad typically forms atop the eroded wafer and slurry particles that are embedded in the porosity or fibers of the polishing pad. Pad glazing is particularly pronounced during planarization of an oxide layer such as a silicon dioxide layer (hereinafter referred to as "oxide CMP"). By way of example, during oxide CMP, eroded silicon dioxide particulate residue accumulates along with abrasive particles from the slurry to form a glaze on the polishing pad. Pad glazing is undesirable because it reduces the polishing rate of the wafer surface and produces a non-uniformly polished wafer surface. The non-uniformity results because glazed layers are often unevenly distributed over a polishing pad surface.

One way of achieving and maintaining a high and stable polishing rate is by conditioning the polishing pad on a regular basis. For example, the polishing pad may be conditioned every time after a wafer has been polished. During pad conditioning, an abrasive conditioning bar or an abrasive disk is typically contacted with the polishing pad, which may be rotating or in an orbital movement.

One type of conditioning operation employs a conditioning bar that swept across the face of rotating polishing pad. The conditioning bar is mounted on a mounting element and includes an abrasive surface. The mounting element imparts pivotal or linear movement to the conditioning bar. The abrasive surface, which often includes diamond particles, operates to condition the polishing pad through the relative motion of the conditioning bar and the polishing pad.

One problem with current conditioning operations is the relatively short life of the conditioning bars. One type of conditioning bar that is commonly used includes a diamond tape or strip that is wrapped over a flexible foam support. The diamond strip may be readily replace as the abrasiveness of the strip degrades. However, the CMP slurry also tends to degrade the flexible foam support. In particular, the harsh chemical environment created by the slurry causes degradation of the flexible foam support, thereby mandating relatively frequent replacement.

An alternative design employs rigid steel bar with diamond grid plates adhered to the steel bar. Among other things, the rigid steel bar design is relatively expensive to manufacture and handle. In particular, providing fixturing features and/or adhering the grid plates requires tooling and processing steps specific to steel. Moreover, the rigid steel bar is not impervious to the slurry chemicals.

Accordingly, a need exists for a CMP polishing pad conditioning bar that avoids or reduces the drawbacks associated with conditioning bars that employ a flexible foam support or a steel support.

SUMMARY OF THE INVENTION

The present invention addresses the above stated needs, as well as others, by providing a conditioning bar that uses a polycarbonate support member on which is supported an abrasion member. Preferably, the polycarbonate support member is reinforced by a rigid metal element, with the polycarbonate member disposed at least in part between the abrasion member and the rigid metal element. By employing a polycarbonate support member, the expense associated with a complex shaped and formed steel conditioning bar is avoided. Even if a rigid metal element reinforcement is employed, the metal reinforcement element need only be a simple bar or rod, which is relatively inexpensive to form. Moreover, the exposure of the metal reinforcement to slurry chemicals is limited by the polycarbonate member, thereby reducing possibility for degradation.

A first embodiment of the invention is a conditioning bar assembly that includes a polycarbonate member, an abrasion member, and a rigid metal element. The abrasion member is supported on an outer surface of the polycarbonate member. The rigid metal element is supported on the polycarbonate member, at least a portion of the polycarbonate member disposed between the rigid metal element and at least a portion of the abrasion member.

Another embodiment of the invention is a conditioning bar assembly that includes an elongate polycarbonate member and an abrasion member. The elongate polycarbonate member is constructed of an inert plastic material. The abrasion member is removably supported on at least one side of the elongate polycarbonate member. Preferably, the abrasion member is an abrasive tape, but may also include abrasive grid plates.

The above discussed features and advantages, will become more readily apparent to those of ordinary skill in the art by reference to the following detailed description and accompanying drawings.

DETAILED DESCRIPTION

Figure 2:
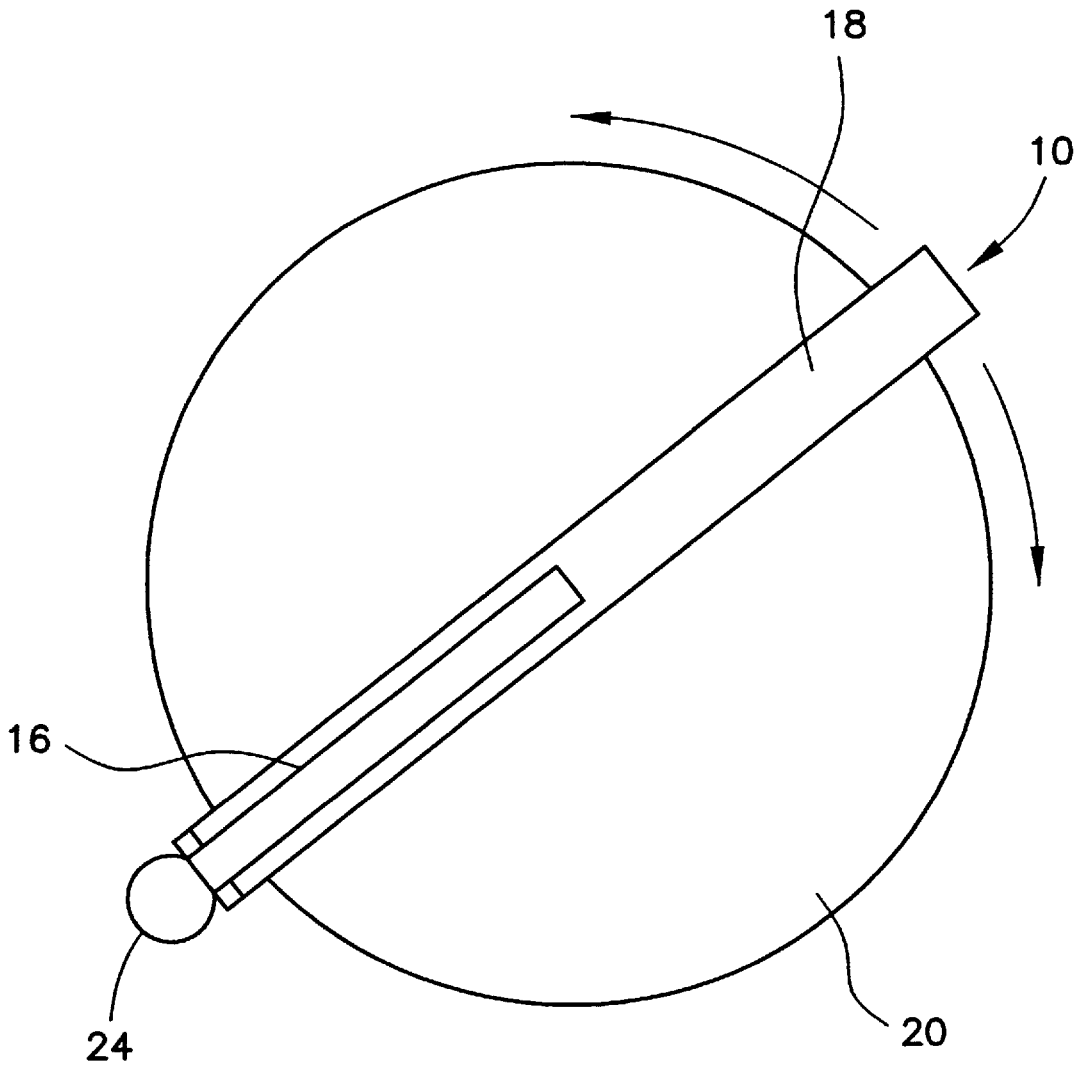
FIG. 2 shows a top plan view of an exemplary conditioning bar assembly according to the present invention performing conditioning on a polishing pad.
Figure 3:
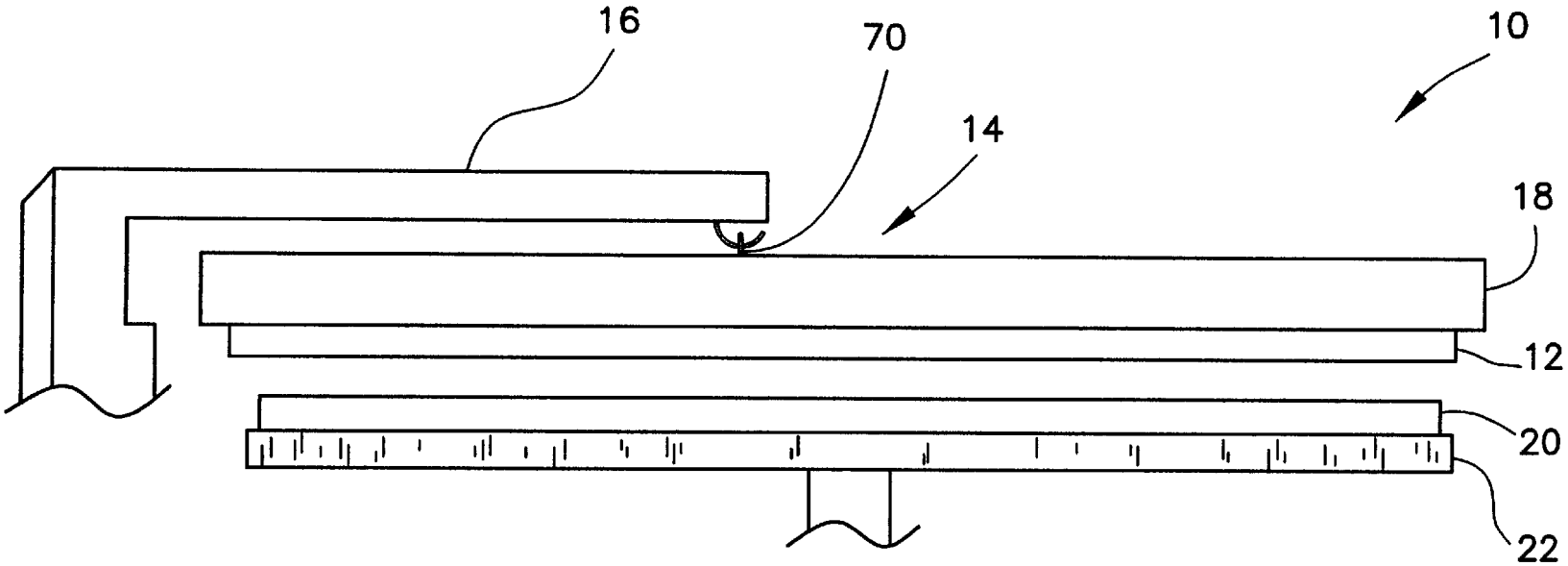
FIG. 3 shows a front plant view of the conditioning bar assembly and polishing pad of FIG. 2.

FIGS. 2 and 3 illustrate a conditioning operation according to the present invention from different view points. With simultaneous reference to FIGS. 2 and 3, a conditioning bar assembly 10 that includes a first embodiment of a conditioning bar 12 according to the present invention operates to condition a CMP polishing pad 20 affixed to a rotating platen 22. To effect the conditioning, the conditioning bar 12 is disposed against the surface of the polishing pad 20 and abrasive particles on the conditioning bar 12 scrape or abrade the polishing pad 20.

The conditioning bar assembly 10 further includes a mounting element 14 on which the conditioning bar 12 is supported. The mounting element 14 operates to support the conditioning bar 12 and move the conditioning bar 12 over the surface of the rotating polishing pad 20.

While the mounting element 14 may take many forms, in the exemplary embodiment described herein the mounting element 14 includes a pivoting support arm 16 and a conditioning bar housing 18. The conditioning bar housing 18 extends in an elongate manner preferably somewhat coextensive with the conditioning bar 12 to provide a sturdy mounting fixture therefor. The pivoting arm 16 is configured to be coupled to a connection extension 70 of the conditioning bar housing 18. The pivoting arm 16 includes a pivoting end 24 and an opposite end, the opposite end connected to the connectoin extension 70. In operation, the pivoting arm 16 moves pivotally back and forth about the pivoting end 24 such that the conditioning bar 12 coupled to the conditioning bar housing 18 sweeps over the entire surface of the polishing pad 20.

It will be appreciated that other mounting elements may be employed, including those that use other types of movement, such as linear or rotational movement. Indeed, it is possible that the mounting element may hold the conditioning bar may be stationery. However, it is preferable to move the conditioning bar in a direction that is different from the rotational movement of the polishing pad in order to reduce the risk of pattern scoring the polishing pad. Pattern scoring may occur when the polishing pad is rotated over the same locations of the conditioning bar such that the effect of individual abrasive anomalies in the conditioning bar are repetitively applied to the same radial ring of the polishing pad. By moving the conditioning bar linearly, or in a pivoting sweep as illustrated, while the polishing pad rotates, pattern scoring is reduced or eliminated.

Referring again to FIGS. 2 and 3, the conditioning bar 12 thus sweeps over the rotating polishing pad 20, thereby conditioning the polishing pad 20 for use in a subsequent CMP polishing operation. It is noted that FIG. 3 shows the conditioning bar 12 spaced apart from the polishing pad 20 only as a result of the partially exploded nature of the diagram. In actual use, the conditioning bar 12 engages the polishing pad 20 surface as discussed above.

Figure 4:
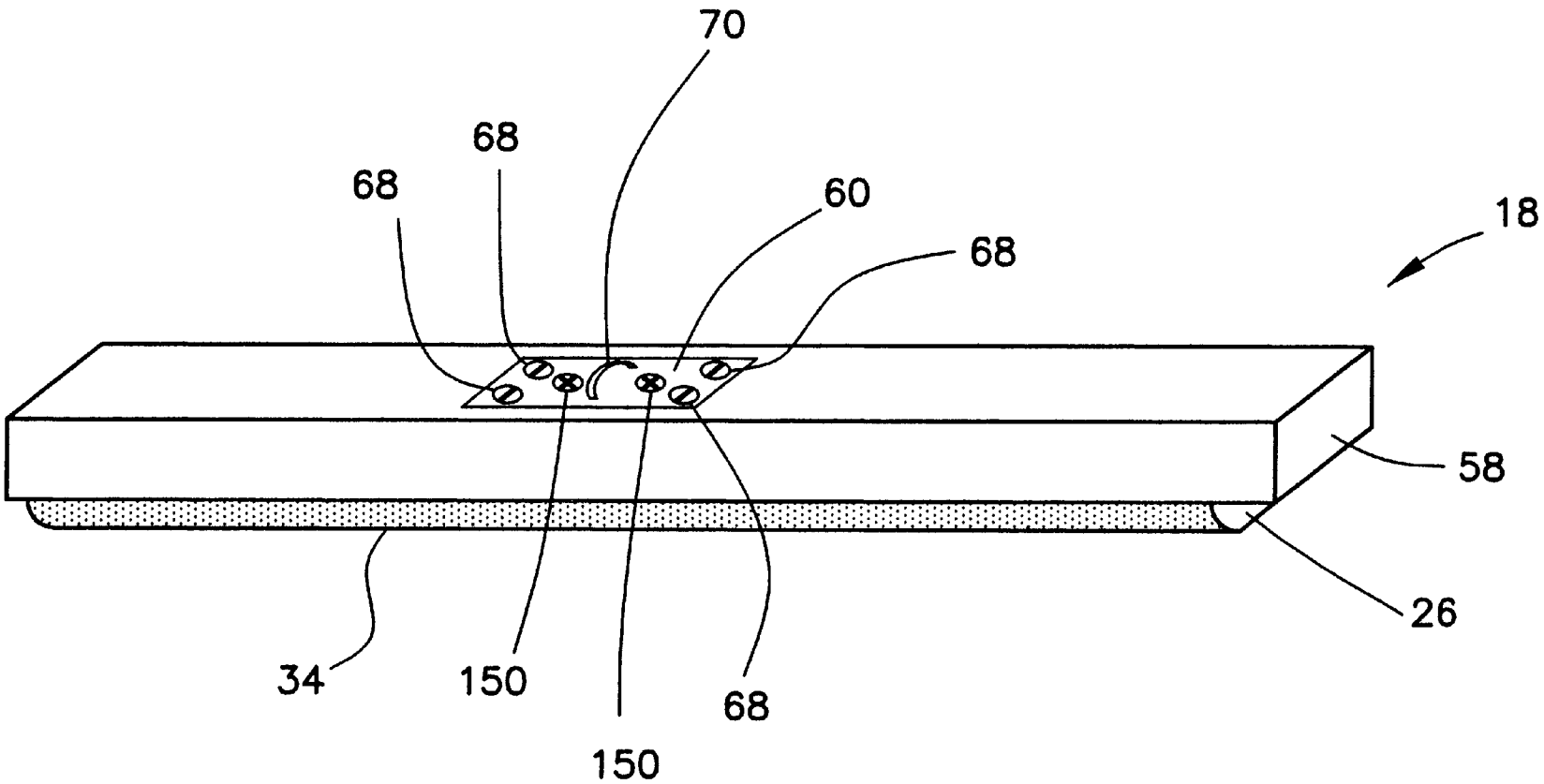
FIG. 4 shows a perspective view of the conditioning bar and the conditioning bar housing of the conditioning bar assembly of FIG. 2 apart from the other elements of the conditioning bar assembly and the polishing pad of FIG. 2.
Figure 5:
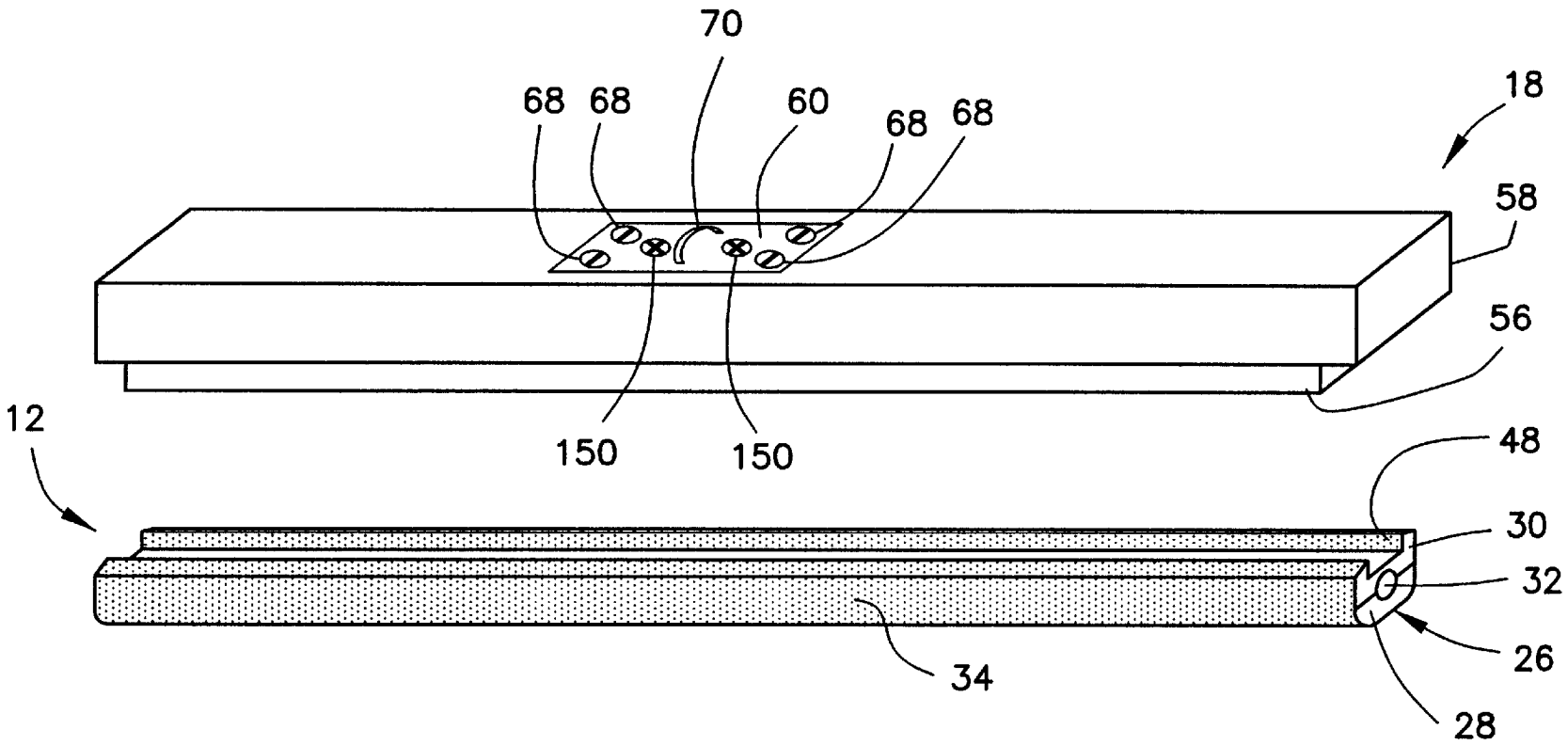
FIG. 5 shows a partially exploded, perspective view of the conditioning bar and conditioning bar housing of FIG. 4.
Figure 6:
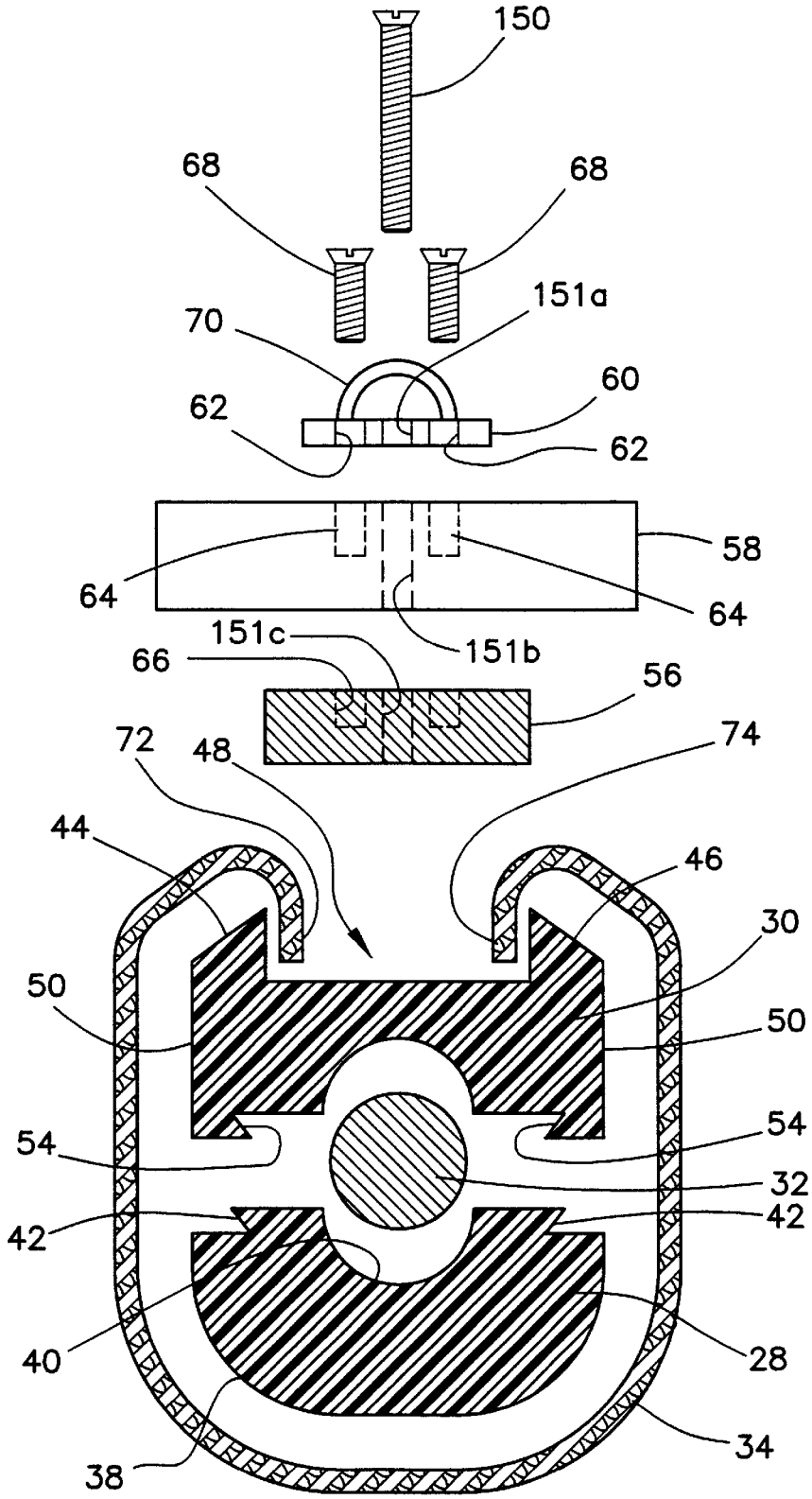
FIG. 6 shows an exploded side plan view of the conditioning bar and conditioning bar housing of FIG. 5.
Figure 7:
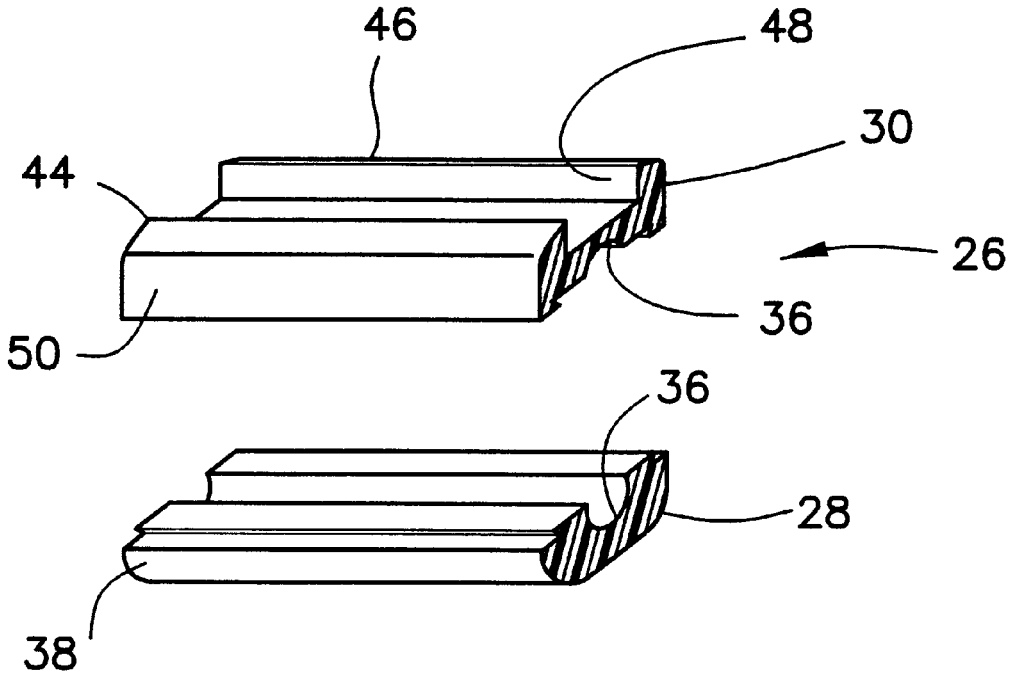
FIG. 7 shows an exploded, sectional view of the support bar of the conditioning bar of FIG. 6.
Figure 9:
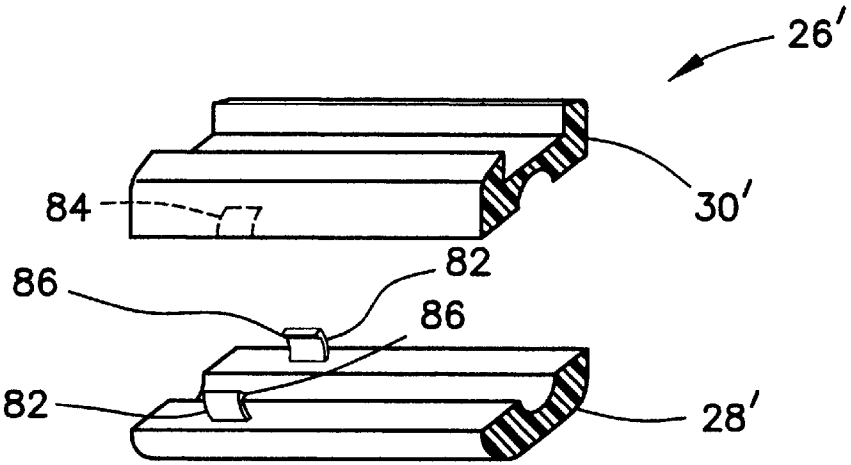
FIG. 9 shows an exploded, sectional view of an alternative support bar of the conditioning bar of FIG. 6.

FIGS. 4, 5 and 6 show in further detail different views of an exemplary conditioning bar 12 and an exemplary conditioning bar housing 18. The conditioning bar 12 and the conditioning bar housing 18 are illustrated in FIGS. 4, 5 and 6 apart from the polishing pad 20 and pivoting support arm 16. Specifically, FIG. 4 shows a perspective view of the conditioning bar 12 assembled into the conditioning bar housing 18, while FIG. 5 shows a partially exploded perspective view wherein the conditioning bar 12 is spaced apart form the conditioning bar housing 18. FIG. 6 shows an exploded side plan view of both the conditioning bar 12 and the conditioning bar housing 18. In addition, FIG. 7 shows a cutaway perspective view of the polycarbonate support bar 26 of the conditioning bar 12. FIG. 9 shows an alternative embodiment of the polycarbonate support bar 26.

With simultaneous reference to FIGS. 4, 5, 6 and 7, the conditioning bar 12 includes the support bar 26 and an abrasion member, which in the embodiment described herein comprises an abrasive strip or tape 34. In the embodiment of FIGS. 4, 5, 6 and 7, the support bar 26 comprises a first polycarbonate member 28 secured to a second polycarbonate member 30. In a preferred embodiment, a rigid metal element 32 is disposed in a hollow cavity 36 that is formed between the first and second polycarbonate members 28 and 30 when they are assembled together.

The abrasive tape 34 is affixed as an outer surface of the conditioning bar 12. Preferably, the abrasive tape 34 is a strip of flexible material on which is adhered diamond grit. Such tape or strip is well known in the art, and may suitably be a diamond abrasive strip, available from 3M Co.

The first polycarbonate member 28 is an elongate structure having a consistent cross-sectional shape throughout its length. As shown in FIG. 6, the first polycarbonate includes a rounded support surface 38 that extends through the entire length of the member 28. The rounded support surface 28 defines the bottom and side surfaces of the member while the top surface is defined by dovetail features 42 and a lower cavity 40. The lower cavity 40 defines a portion, and preferably half, of the hollow cavity 36 that receives the rigid metal element 32. Extending from either side of the lower cavity to the ends of the rounded support surface 28 are the dovetail features 42. The dovetail features 42 are stepped horizontal surface preferably connected by an acute-angled surface. The dovetail features 42 are configured to engage complementary features on the second polycarbonate member 30 as a mechanical retention means, as will be discussed below.

The second polycarbonate member 30 is also an elongate structure also preferably having a consistent cross-sectional shape throughout its length. The first polycarbonate member 28 and the second polycarbonate member 30 are preferably the same length and same approximate width, as shown in FIGS. 5 and 6. The second polycarbonate member includes two opposite upright support surfaces 50 defining the sides thereof. The two opposite upright surfaces 50 are configured to form a relatively continuous surface with the rounded support surface 28 when the support bar 26 is fully assembled (see e.g. FIG. 5). The top surface of the second polycarbonate member 30 includes two extensions 44 and 46 extending upward from, respectively, the two upright surfaces 50. The two extensions 44, 46 extend upward from the main central portion of the top of the second member to define a channel 48 therebetween.

The bottom surface of the second polycarbonate member 30 includes an upper cavity 52 and opposite dovetail features 54. The upper cavity 52 defines a portion, preferably half, of the hollow cavity 36 that receives the rigid metal element 32. Extending from either side of the upper cavity 52 and to the bottom ends of the upright support surfaces 50 are the dovetail features 54. The dovetail features 54 are configured to complementarily engage the dovetail features 42 of the first polycarbonate member 28. To this end, the dovetail features 54 may similarly comprise stepped horizontal surface connected by an acute, angled surface.

Preferably, both the first and second polycarbonate members 28, 30 are constructed of an inert plastic material. The inert plastic material is preferably inert to common industrial slurries. For example, the plastic material preferably has inert qualities for pH levels of 2 to approximately 11. Examples of suitable inert materials include Delrin and Ertalyte, both of which are available from DuPont. Those of ordinary skill in the art may readily determine other suitable plastic materials that exhibit the required structural and chemically inert qualities.

The abrasive tape 34 extends longitudinally along the length of the support bar 26. The abrasive tape 34 has a width that extends between substantially parallel opposing edges 72 and 74. The first edge 72 is disposed at least partially within the channel 48. The remainder of the abrasive tape 34 extends, preferably tightly, from the first edge 72 over the first extension 44, down the adjoining upright support surface 50, around the rounded support surface 38, up the other upright support surface 50, over the second extension 46, and at least partly into the channel 48. Thus, the second edge 74 also extends at least partially into the channel 48. In general, the abrasive tape 34 is held in place through a clamping force exerted by the mounting bar 56 (see below) when the mounting bar 56 is disposed within the channel 48. The mounting bar 56 is a portion of the conditioning bar housing 18 discussed further below.

It will be appreciated, however, that the abrasive tape 34 may be arranged in other ways, so long as it substantially covers the bottom portions of the support bar 16 and is securely fastened onto the support bar 16. For example, the edges 72 and 74 of the abrasive tape 34 may instead be trapped between the first and second polycarbonate members 28 and 30. However, the embodiment illustrated in FIG. 6 has additional advantages of providing an easy changeout.

It will be appreciated that the means other than the dovetail features 42 and 54 may be employed to connect the two polycarbonate members 28 and 30. For example, FIG. 9 shows a perspective exploded view of two polycarbonate members 28' and 30' that combine to form support bar 26' similar to the support bar 26. In the embodiment of FIG. 9, the polycarbonate member 28' includes retention extensions 82 that extend upward from the top surface thereof. The retention extensions 82 do not necessarily extend the length of the polycarbonate member 28'. The other polycarbonate member 30' includes corresponding openings 84 for receiving the retention extensions 82. The retention extensions preferably include barbs or overhangs 86 that engage ledges, not shown, in the openings 84 to retain the retention extensions 82 therein. Thus, to construct the support bar 26', the retention extensions are inserted into the openings 84 until the overhangs 86 snap into place. The rigid metal element 32 may optionally be inserted prior to assembling the support bar 26'.

In another embodiment, the support bar 26 may suitably be formed as a single, integral piece having an interior bore for receiving the rigid metal element 34.

Turning now to the conditioning bar housing 18, it will be appreciated that the conditioning bar housing 18 may take a plurality of forms without departing from the spirit and scope of the present invention. The embodiment shown in FIGS. 4, 5 and 6 are given by way of example only.

Referring to FIGS. 4, 5, and 6, the conditioning bar housing 18 includes the mounting bar 56, a top support 58, and a connector plate 60. The mounting bar 56 is a generally elongate rectangular piece having a rectangular cross section. In general, the mounting bar 56 has a configuration that is intended to fit snugly within the channel 48 of the conditioning bar 12. Accordingly, in alternative designs, the mounting bar 56 may have cross sections of other shapes, provided that the channel 48 has a corresponding shape. The mounting bar 56 is preferably constructed of steel or another rigid material.

The top support 58 is preferably an elongate plastic rectangular element. Coupled to the top support 58 is the connector plate 60. The connector plate 60 in the exemplary embodiment described herein comprises a rectangular metal plate that includes four screw openings 62 disposed near each corner of the metal plate. The connector plate 60 further includes a connector extension 70. The connector extension 70 is configured to receive a clamping element or device on the pivoting support arm, not shown. To this end, the exemplary connector extension 70 of FIGS. 4, 5 and 6 is in the form of an arcuate loop extending upward from the metal plate.

A set of four screws 68 connect the top support 58 to the connector plate 60. To this end, each screw 68 is rotatably inserted through screw openings 62 in the connector plate 60, and through screw openings 64 in the top support 58.

In general use of the conditioning bar 12, the support bar 26 is generally constructed with the rigid metal element 32 disposed therein. The resulting assembly of the support bar 26 and metal element 32 is, in the exemplary embodiment described herein, fairly permanent in nature. The abrasive tape 34, by contrast, may be replaced several times throughout the life of the support bar 26. In particular, the abrasive tape 34 is subject to extensive wear during use, thereby requiring its periodic replacement. However, due to the modular nature of the design of the conditioning bar 12, the abrasive tape 34 may be readily replaced without requiring wholesale replacement of the conditioning bar 12.

To construct the conditioning bar 12, the rigid metal element 32 is disposed in the lower cavity 40 of the first polycarbonate member 28. The second polycarbonate member 30 is aligned axially beside the first polycarbonate member 30 such that the respect dovetail features 42 and 54 are aligned for engagement. The two members 28 and 30 are then slid together in the axial direction with their respect dovetail features 42 and 54 engaging. Alternatively, the second polycarbonate member 30 and the first polycarbonate member 28 may be snapped together. In a preferred mode, an adhesive is used to on the engaging dovetail features prior to sliding engagement. After the two members 28 and 30 are assembled to form the support bar 26 with the rigid metal element 32 enclosed therein, the adhesive may set up.

Prior to use of the conditioning bar 12, the abrasive tape 34 is assembled onto the support bar 26. The abrasive tape 34 typically is dispensed from a roll, not shown. The piece of abrasive tape 34 used in the conditioning bar 12 is wrapped around the support bar 26 as discussed further above. In particular, the edges 72 and 74 are disposed within the channel 48 with the middle portion of the abrasive tape 34 of the extending tautly around the upright support surfaces 50 and the rounded support surface 38 of the support bar 26.

With the abrasive tape 34 in position, the conditioning bar 12 is installed into the housing 18 by inserting the mounting bar 56 into the channel 48. Then, two additional screws 150 are inserted through openings 151*a*, 151*b* and 151*c* located in the top plate 60, the top support 58 and the mounting bar 58, respectively. The screws 150 then rotatably engage the second polycarbonate member 30. The screws 150 thus hold the mounting bar 56 of the housing 18 within the channel 48 of the conditioning bar 12. In such position, the mounting bar 56 traps the edges 72 and 74 of the abrasive tape 34 within the channel 48, thereby holding the abrasive tape 34 in place.

Figure 1:
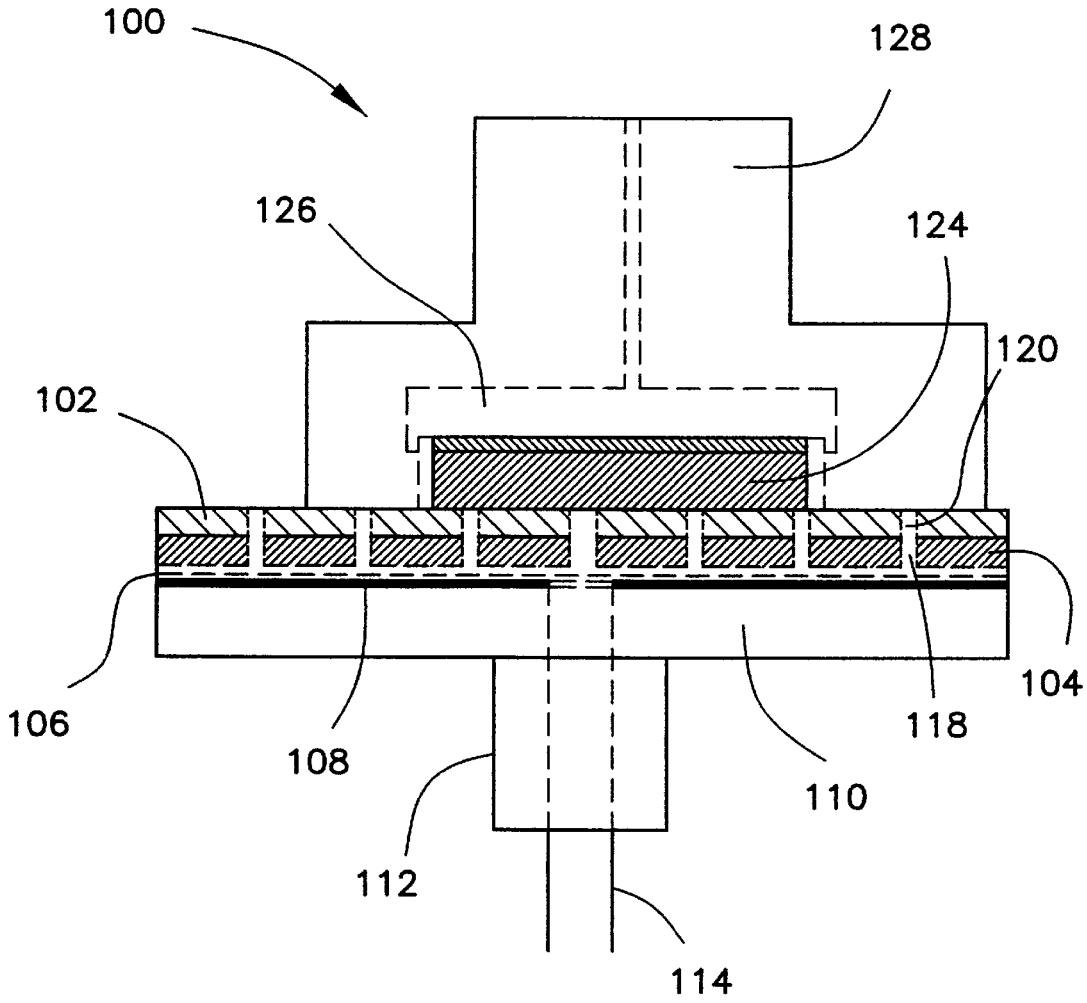
FIG. 1 (PRIOR ART)
FIG. 1 shows a cross-sectional view of a typical chemical mechanical polishing or planarization apparatus.

In operation, the conditioning bar 12, once assembled on to the housing 18 and thus the mounting element 14 of FIGS. 1 and 2, may now be used to in the conditioning of polishing pads as described above in connection with FIGS. 1 and 2. After some amount of use, however, the abrasive tape 34 degrades from use and exposure to slurry chemicals. At that point, the abrasive tape 34 of the conditioning bar 12 may be replaced.

To this end, conditioning bar 12 is removed from the conditioning bar housing 18. As the conditioning bar 12 is removed, the mounting bar 56 exits the channel 48. With the mounting bar 56 out of the channel 48, the edges 72 and 74 are no longer trapped within the channel 48 and, as a consequence, the degraded abrasive tape 34 may be removed. Thereafter, a new piece of abrasive tape 34 may be installed on to the conditioning bar 12 and the conditioning bar 12 installed on the conditioning bar housing 18 as described above.

Figure 8:
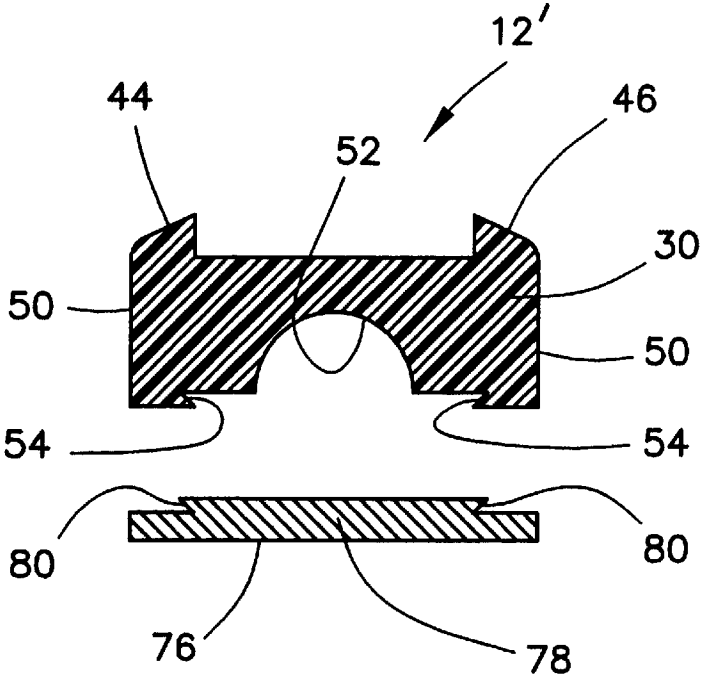
FIG. 8 shows an exploded, end plan view of a conditioning bar according to an alternative embodiment of the invention.

In an alternative embodiment, the abrasive tape 34 may be replaced by another modular type abrasive member. For example, FIG. 8 shows a side view of an alternative embodiment of a conditioning bar 12' according to the present invention. In the alternative embodiment, the abrasive member comprises abrasive grid plates 78, and preferably diamond grid plates. In the exemplary embodiment described herein, the abrasive grid plates 78 are designed to fit directly onto the second polycarbonate member 30 or a piece similarly constructed. To this end, the abrasive grid plates 78 include dovetail features 80 that allow the grid plates 78 to be slidingly engaged with the corresponding dovetail features 54 on the second polycarbonate member 30.

In the exemplary embodiment described herein, the abrasive grid plates have a diamond grit surface to effect the conditioning abrasion against the polishing pad. In general, generic diamond grid plates are available from 3 M Co., Abrasive Tech, and Nippon Steel. Such grid plates may readily be machined to include the dovetail features, or in the alternative, the grid plates may be formed originally with the dovetail features.

It will be appreciate that the embodiment of FIG. 8 may readily be employed with polycarbonate members of somewhat different design and still obtain many of the benefits of the present invention. For example, one reason that the upper cavity 52 is included in the embodiment of FIG. 8 is to illustrated that in one aspect of the invention, the abrasive tape 34 of FIG. 6 and abrasive grid plates 78 of FIG. 8 may be interchangeably be used with the same polycarbonate member 30. However, alternative implementations of the embodiment of FIG. 8 need not include the upper cavity 52. Likewise, the dovetail technique of joining the grid plates 78 to the polycarbonate member 30 is given by way of example only. Other connection arrangements may be employed, including other mechanical fittings, mechanical clamps, or gluing.

It will be appreciated that the above described embodiments are merely illustrative, and that those of ordinary skill in the art may readily devise their own implementations that incorporate the principles of the present invention and fall within the spirit and scope thereof.

We claim:

1. A conditioning bar assembly comprising:

a polycarbonate member;

an abrasion member supported on an outer surface of the polycarbonate member; and a rigid metal element supported on the polycarbonate member, at least a portion of the polycarbonate member disposed between the rigid metal element and at least a portion of the abrasion member.

2. The conditioning bar assembly of claim 1, wherein the polycarbonate member is an elongate polycarbonate member.

3. The conditioning bar assembly of claim 1 wherein the polycarbonate member comprises a hollow elongate member, and wherein the rigid metal element is disposed within the hollow elongate member.

4. The conditioning bar assembly of claim 1 further comprising a second polycarbonate member, the second polycarbonate member secured to the polycarbonate member, the rigid metal element disposed between the polycarbonate member and the second polycarbonate member.

5. The conditioning bar assembly of claim 4 wherein the second polycarbonate member is mechanically connected to the polycarbonate member.

6. The conditioning bar assembly of claim 1 wherein the abrasion member comprises an abrasive tape.

7. The conditioning bar assembly of claim 6 wherein the abrasive tape includes diamond particles.

8. The conditioning bar assembly of claim 1 wherein the polycarbonate material is constructed of an inert polycarbonate material.

9. The conditioning bar assembly of claim 1, further comprising a mounting element, the mounting element configured to engage the polycarbonate member.

10. A conditioning bar assembly comprising:

an elongate polycarbonate member, the polycarbonate member constructed of an inert plastic material;

a second polycarbonate member secured to the elongate polycarbonate member;

a rigid metal element disposed between the elongate polycarbonate member and the second polycarbonate member; and an abrasion member removably supported on at least one side of the elongate polycarbonate member.

11. The conditioning bar assembly of claim 10 wherein the inert plastic material is inert to slurries having a pH of greater than 2.

12. The conditioning bar of claim 10 wherein the abrasion member comprises an abrasive tape.

13. The conditioning bar of claim 10 wherein the abrasion member comprises at least one abrasive grid plate.

14. The conditioning bar assembly of claim 10, wherein the second polycarbonate member is secured to the elongate polycarbonate member by mating dovetail features.

15. The conditioning bar assembly of claim 10 wherein the second polycarbonate member is connected to the polycarbonate member at least in part by a mechanical retention member.

16. A method of operating a conditioning bar assembly in a chemical mechanical planarization operation comprising:

supporting a first abrasion member on an inert elongate polycarbonate member;

supporting a rigid metal element on the inert elongate polycarbonate member such that at least a portion of the inert elongate polycarbonate member is disposed between the rigid metal element and at least a portion of the first abrasion member;

employing the inert elongate polycarbonate member and the first abrasion member to effect polishing pad conditioning;

removing the first abrasion member from the inert elongate polycarbonate member;

supporting a second abrasion member on the inert elongate polycarbonate member; and employing the inert elongate polycarbonate member and the second abrasion member to effect polishing pad conditioning.

17. The method of claim 16 wherein the step of supporting a first abrasion member includes supporting at least a portion of the first abrasion member on the second polycarbonate member.

18. The method of claim 16 wherein the step of supporting the rigid metal element further comprises securing a second polycarbonate member to the inert elongate polycarbonate member such that the rigid metal element is disposed between the inert elongate polycarbonate member and the second polycarbonate member.

19. The method of claim 18 wherein the step of supporting the rigid metal element further comprises mechanically securing the second polycarbonate member to the inert elongate polycarbonate member.

* * * * *